US010697180B2

(12) United States Patent
Vasiliev

(10) Patent No.: US 10,697,180 B2
(45) Date of Patent: Jun. 30, 2020

(54) METHOD FOR HEAT INSULATING A BUILDING SURFACE AND AN INSULATION BOARD THEREFOR

(71) Applicant: Rockwool International A/S, Hedehusene (DK)

(72) Inventor: Maxim Vasiliev, Moscow (RU)

(73) Assignees: Rockwool International A/S, Hedehusene (DK); LIMITED LIABILITY COMPANY "ROCKWOOL", Balashikha, Moscow Region (RU)

( * ) Notice: Subject to any disclaimer, the term of this patent is extended or adjusted under 35 U.S.C. 154(b) by 0 days.

(21) Appl. No.: 16/314,968

(22) PCT Filed: Jun. 29, 2017

(86) PCT No.: PCT/EP2017/066096

§ 371 (c)(1),
(2) Date: Jan. 3, 2019

(87) PCT Pub. No.: WO2018/007231

PCT Pub. Date: Jan. 11, 2018

(65) Prior Publication Data

US 2019/0309520 A1 Oct. 10, 2019

(30) Foreign Application Priority Data

Jul. 6, 2016 (RU) ..... 2016127071

(51) Int. Cl.

| | |
|---|---|
| ***E04D 3/35*** | (2006.01) |
| ***E04B 1/80*** | (2006.01) |
| ***E04D 13/16*** | (2006.01) |

(52) U.S. Cl.
CPC ..... *E04D 3/358* (2013.01); *E04B 1/80* (2013.01); *E04D 13/16* (2013.01)

(58) Field of Classification Search
CPC ..... E04B 1/7658; E04B 1/80; E04D 3/358; E04D 13/16; F16L 59/029
See application file for complete search history.

(56) References Cited

U.S. PATENT DOCUMENTS 2,047,154 A * 7/1936 Pimsner ..... E04C 2/292 52/275
2,159,053 A * 5/1939 Saboraky ..... F24C 15/34 52/406.2

(Continued)

FOREIGN PATENT DOCUMENTS

DE 29718016 U1 1/1998
EP 1180182 B1 5/2007

(Continued)

*Primary Examiner* — James M Ference
(74) *Attorney, Agent, or Firm* — Dinsmore & Shohl LLP

(57) ABSTRACT

The present invention concerns a method for heat insulating a building surface with insulation boards, wherein each insulation board has two parallel main surfaces and four side surfaces connecting the two large surfaces, whereby the insulation boards are arranged adjacently on the building surface with each insulation board having a lowermost of the main surfaces facing the building surface, wherein each insulation board is divided into an upper part and a lower part with an interface that is substantially parallel with the two main surfaces, and wherein the method comprises the steps of arranging an insulation board on the building surface and then shifting the upper part of said insulation board a distance to at least partly cover a lower part of at least one neighbouring insulation board. The invention also concerns an insulation board for use in the method.

12 Claims, 2 Drawing Sheets

(56) References Cited

U.S. PATENT DOCUMENTS 2,354,186 A * 7/1944 Donahue ..... B65D 85/07 206/321
2,913,104 A * 11/1959 Parker ..... B65D 75/38 206/321
3,111,787 A * 11/1963 Chamberlain ..... E04D 3/358 52/309.9
3,121,649 A * 2/1964 Oliver ..... E04D 13/16 52/746.11
3,468,086 A * 9/1969 Warner ..... E04D 3/351 52/173.1
3,894,372 A * 7/1975 Roberts ..... B32B 5/18 220/560.06
4,615,162 A * 10/1986 Evans ..... E04B 2/707 52/409
4,709,523 A * 12/1987 Broderick ..... E04B 1/767 428/124
4,952,441 A * 8/1990 Bose ..... B32B 27/12 428/121
5,001,879 A * 3/1991 Paliwoda ..... E04C 2/288 52/309.8
5,285,609 A * 2/1994 Goad ..... E04C 2/292 52/588.1
5,331,787 A * 7/1994 Paulitschke ..... E04B 1/7654 206/321
5,617,687 A * 4/1997 Bussey, Jr. ..... E04B 1/762 156/71
6,006,481 A * 12/1999 Jacobs ..... B32B 5/18 52/309.9
7,351,459 B2 * 4/2008 Fay ..... E04B 1/767 428/137
7,485,358 B2 * 2/2009 Benaets ..... B32B 3/06 428/124
7,530,204 B2 * 5/2009 Cook ..... B32B 7/02 52/268
2001/0022059 A1 * 9/2001 Bol ..... E04D 13/1668 52/741.41
2001/0054265 A1 * 12/2001 Geissels ..... E04B 1/762 52/311.1
2004/0137181 A1 * 7/2004 Ruid ..... B32B 5/26 428/36.91
2004/0226247 A1 * 11/2004 Byrd ..... E04D 3/35 52/518
2005/0112966 A1 * 5/2005 Toas ..... B32B 5/26 442/35
2005/0144850 A1 * 7/2005 Hageman ..... E04D 3/351 52/3
2005/0166539 A1 * 8/2005 Nowack ..... E04C 2/292 52/782.1
2006/0019568 A1 * 1/2006 Toas ..... E04B 1/80 442/381
2006/0096213 A1 * 5/2006 Griffin ..... E04C 2/296 52/409
2006/0165938 A1 * 7/2006 Sircelj ..... B32B 3/06 428/57
2007/0130864 A1 * 6/2007 Semmens ..... E04D 7/00 52/408
2008/0138526 A1 * 6/2008 Tutin ..... E04B 1/767 427/372.2
2008/0163586 A1 * 7/2008 Goulet ..... E04C 2/243 52/794.1
2008/0197316 A1 * 8/2008 Yang ..... D04H 1/60 252/62
2010/0031593 A1 * 2/2010 Klose ..... E04D 13/1693 52/309.13
2010/0287860 A1 * 11/2010 Fernandez-Cavo ..... E04B 1/7658 52/235
2013/0171900 A1 * 7/2013 Bauer ..... B32B 5/02 442/181
2014/0154478 A1 * 6/2014 Fellinger ..... C09J 7/21 428/195.1
2014/0190107 A1 * 7/2014 Beckers ..... E04D 11/02 52/309.13
2014/0202788 A1 * 7/2014 Hansen ..... E04B 1/84 181/290
2014/0215961 A1 * 8/2014 Pedersen ..... B65D 71/0096 52/745.06
2015/0218813 A1 * 8/2015 Koca ..... E04C 2/525 52/173.1
2015/0330080 A1 * 11/2015 Nielsen ..... E04B 1/80 428/137
2019/0309520 A1 * 10/2019 Vasiliev ..... E04D 13/16

FOREIGN PATENT DOCUMENTS

WO 0073600 A1 12/2000
WO 03012220 A1 2/2003
WO 03054264 A1 7/2003
WO 03095756 A1 11/2003
WO 2012000585 A1 1/2012
WO 2012059192 A1 5/2012

* cited by examiner

METHOD FOR HEAT INSULATING A BUILDING SURFACE AND AN INSULATION BOARD THEREFOR

REFERENCE TO RELATED APPLICATIONS

This application is a U.S. national stage of PCT/EP2017/066096, filed Jun. 29, 2017, which claims priority to Russian Application No. 2016127071, filed Jul. 6, 2016, the entire content of both of which is incorporated herein by reference.

FIELD OF THE INVENTION

The present invention relates to a method for heat insulating a building surface and an insulation board therefor.

BACKGROUND OF THE INVENTION

Heat insulation of buildings is well-known and there are numerous systems and products for insulating building surfaces, such as roofs and walls. The requirements to the insulation quality are constantly increasing which requires improved insulation systems and/or improved skills by the insulation installer. The requirements are mainly directed to improved insulation value which is often achieved by increasing the insulation thickness. Another issue is to avoid thermal bridges, so-called cold bridges, which often are caused by poorly installed insulation boards having gaps between them. A common way to meet these two requirements is to use a two-layer solution, wherein a first layer of insulation boards is first installed and then a second layer of insulation boards is installed on top of the first layer with the insulation boards of the second layer being shifted in relation to the insulation boards of the first layer.

If the building surface to the insulated is a flat, or substantially flat, roof it is often required that the installed insulation shall be able to support person traffic or even heavier traffic. This may be achieved by using a two-layer solution, wherein the first layer comprises heat insulation elements or boards and the second layer is a force distributing layer made of high density heat insulation boards or other materials.

A packing and/or transport unit with roof insulation elements for a two-layer solution is known from WO 2012/059192. The insulation elements include a number of lamellae and a few insulation boards, i.e. at least two different types. The insulation elements are used to insulate a flat roof construction. A predetermined number of transport units are provided on the roof. The elements of each of the transport units are laid out in two layers whereby an insulating layer is built on the roof. The two layers are typically made as a lower layer of lamellae and a top layer of larger insulation boards preferably having a higher density than the lower layer to provide a roof insulation which can carry load from e.g. building workers on the roof. The lamellae and the top layer boards are preferably provided in a staggered configuration. This solution is advantageous but does involve handling of many elements during the fitting of the roof insulation, which in turn is labour intensive and time consuming.

In another solution, which after installation looks like a two-layer solution, is to use so-called dual density insulation boards for flat roof insulation, wherein the two layers are included in a single product, namely an insulation board having a first layer of relatively low density and a second layer of higher density. An example of a dual density insulation board is known from e.g. WO 03/054264 A1.

A disadvantage with using the dual density products is though that when installing the dual density boards on the roof there is a risk that a gap will be provided between two adjoining boards creating a cold bridge from the roof to the roof membrane on top of the dual density boards. There is also a risk that the two adjoining dual density boards are slightly different in thickness and thereby the top surface of the insulation will not be at the same level thus creating one or more small steps from one dual density board to another. Such unevenness will be visible on the roof membrane provided as the exterior roof cover and does entail a risk of damage to the roof membranes, for instance as pools of rain water may form, or the like.

SUMMARY OF THE INVENTION

It is therefore an object by the present invention to provide a method for heat insulating a building surface, such as a flat, or substantially flat, roof and an insulation board therefor which alleviates or even eliminates the above-mentioned drawbacks.

According to a first aspect of the invention there is provided a method for heat insulating a building surface with insulation boards, wherein each insulation board has two parallel main surfaces and four side surfaces connecting the two large surfaces, whereby the insulation boards are arranged adjacently on the building surface with each insulation board having a lowermost of the main surfaces facing the building surface, wherein each insulation board is divided into an upper part and a lower part with an interface that is substantially parallel with the two main surfaces, and wherein the method comprises the steps of arranging an insulation board on the building surface and then shifting the upper part of said insulation board a distance to at least partly cover a lower part of at least one neighbouring insulation board.

The advantage hereby achieved is that a two-layer building insulation may be provided by insulation boards which are handled as a single product but which overcomes the issues of cold bridging due to gaps between insulation boards.

It should be mentioned that the term "lower part" when used in this specification refers to the part of the insulation board that in use is facing the building surface, while the term "upper part" refers to the part of the insulation board that faces away from the building surface. In a preferred embodiment that building surface is a flat, or substantially flat, roof. However, the invention is also applicable to a building surface in form of a more or less vertical wall.

In a second aspect of the invention there is provided an insulation board comprising a upper part made of fibrous mineral material and a lower part made of fibrous mineral material, wherein the upper part is shiftable relative to the lower part. Preferably, the upper part and the lower part are made of stone wool.

Preferably, the upper part of the insulation board has a first density within the range of 100-250 kg/m$^3$ and the lower part has a second density within the range of 50-140 kg/m$^3$, and wherein the first density is higher than the second density.

In some preferred embodiments of the invention, the upper part has a first thickness which is 5-50% of the total product thickness and the lower part has a second thickness of 50-95% of the total product thickness.

By the invention, the upper part is shiftable relative to the lower part in either one or two directions by pushing or pulling the top part relative to the lower part.

To produce such a board, the third aspect of the invention is the provision of a method for producing insulation boards for use in the method for insulating a building surface, wherein the method comprises the following steps:

producing a cured web of mineral wool insulation, said web having an upper surface and a lower surface;

dividing the web of mineral wool insulation into an upper part an a lower part that are kept together with an interface substantially parallel with the upper and lower surfaces;

cutting the mineral wool web lengthwise and laterally into insulation boards.

It is preferred that the web before curing is divided into an upper part and a lower part; the upper part or lower part is compressed to a higher density than the other; re-assembling of the upper part and lower part; and then curing the re-assembled web. Thereby a dual density product is provided. Further to these production steps, then the higher density upper part is split from the lower density lower part.

According to this method the dual density board may be provided by horizontally dividing a known dual density product into the two layers. This can easily be implemented on the existing production lines by arranging a horizontal knife or saw after the dual density products has exited the curing oven.

Preferably, the split is provided at the interface between the high density and the low density in the dual density product. However, if appropriate the split can be provided at other positions.

In an embodiment, each divided insulation board comprising an upper part and a lower part are wrapped individually in a packaging foil. Alternatively, the boards may be stacked in a transport unit, e.g. on a pallet.

BRIEF DESCRIPTION OF THE DRAWINGS

In the following, the invention is described in more detail with reference to the accompanying drawings, in which.

DETAILED DESCRIPTION OF THE INVENTION

Figure 1:
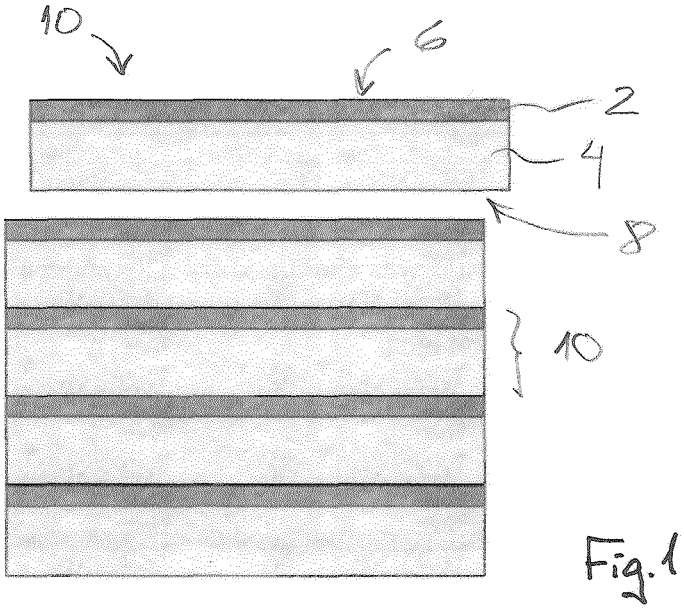
FIG. 1 is a stack of insulating boards according to an embodiment of the invention.

FIG. 1 shows a stack of insulation boards 10 according to the invention ready to be installed on a building surface, such a flat roof or a wall (not shown). On the building site each insulation board 10 can be handled as a single element as indicated with the uppermost insulation 10 which is taken away from the stack. The insulation board 10 is split such that the insulation hoard 10 consists of an upper part 2 and a lower pail 4. Each insulation board 10 also has a top main surface 6 and a bottom main surface 8. Both the upper part 2 and the lower part 4 is preferably made of fibrous mineral wool, such as stone wool; the upper part 2 with a high density, for instance within the range of 100-250 kg/m$^3$, and the lower part 4 with a second lower density, preferably within the range of 50-140 kg/m$^3$.

Figure 2:
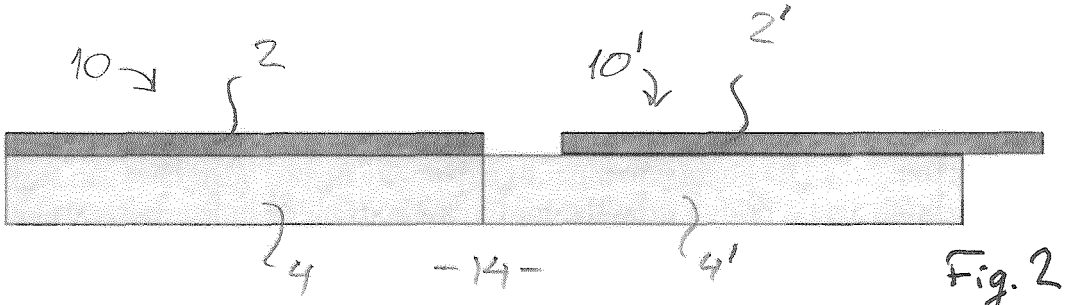
FIG. 2 is a schematic side view of two adjoining insulating boards during the process of installing such insulation boards on a flat roof.
Figure 3:
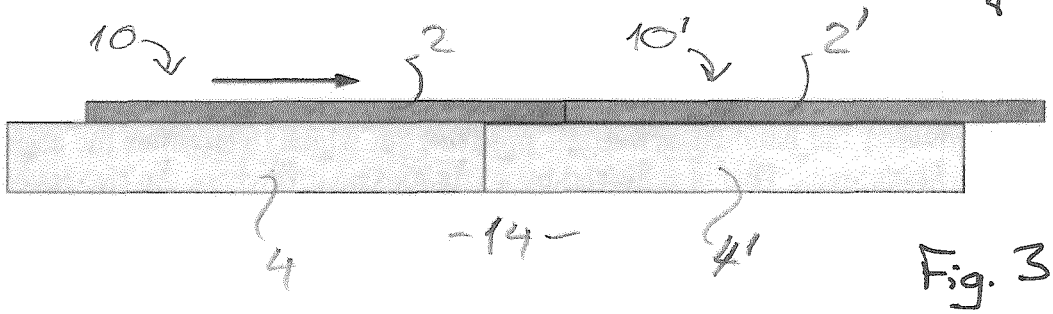
FIG. 3 is the same as FIG. 2 when the insulation boards are installed.

As indicated in the FIGS. 2 and 3, the insulation boards 10, 10' are arranged on a flat roof 14. After the adjoining insulating boards 10, 10' are placed, the upper parts 2, 2' are then shifted by pushing or pulling to at least partly cover a lower part 4, 4' of a neighbouring or adjoining insulation board 10, 10' and thereby also cover the interface of the lower parts 4, 4' between the adjoining insulation boards 10, 10'. The shifting of the upper parts 2, 2' may be in one direction only or in two directions so that all interfaces between adjacent lower parts 4, 4' are covered, by shifted upper parts 2, 2'.

Figure 4:
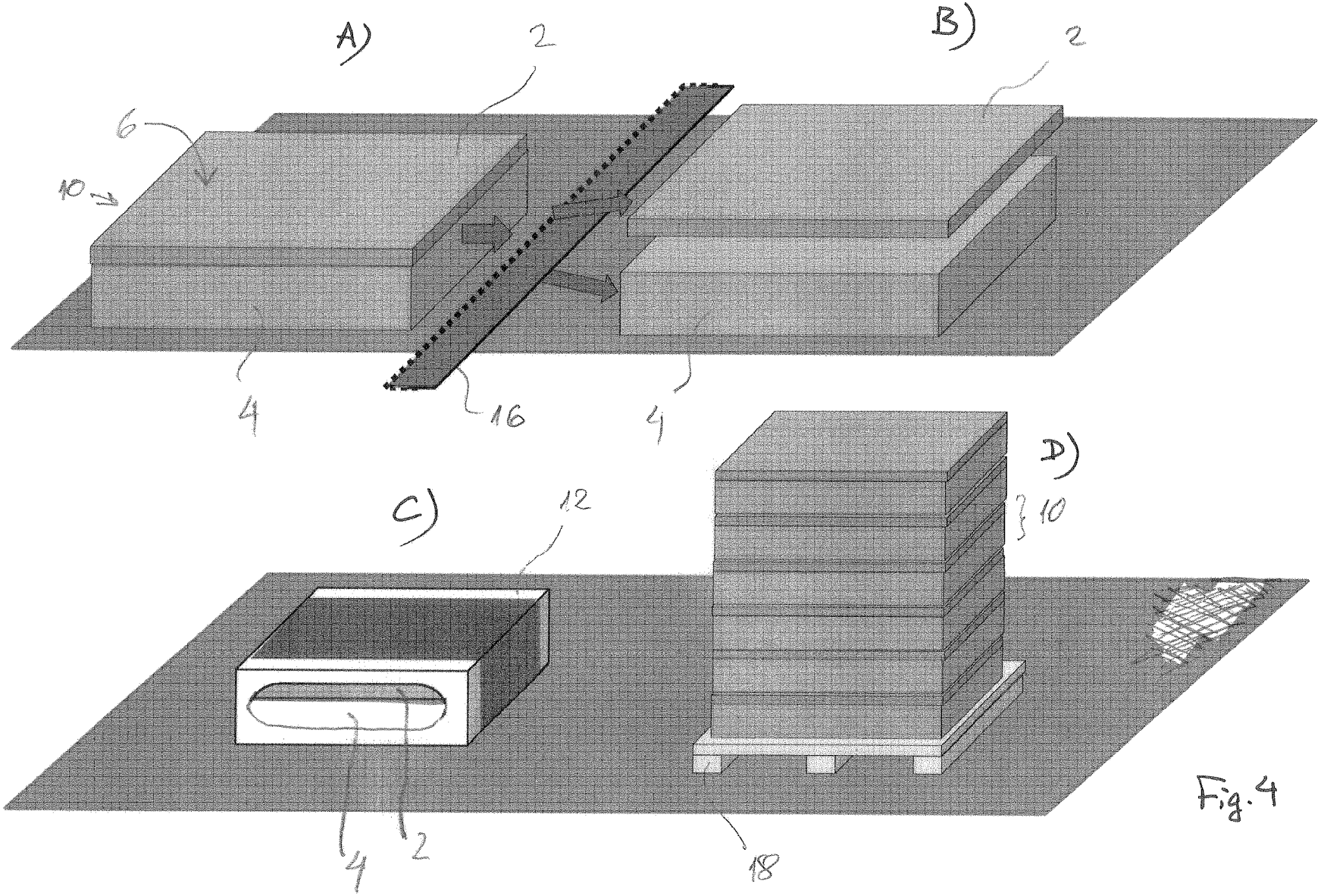
FIGS. 4 *a*) to *d*) show an example of the steps of producing a roof insulation board according to the invention.

As shown in FIG. 4D the stack of insulation boards 10 shown in FIG. 1 may be provided on a pallet 18, which may be made of wood or can be made of fibrous mineral wool similar to the insulation boards 10, so that the pallet 18 can form part of the building surface insulation. This stack of insulation boards 10 on the pallet 18—preferably wrapped in packaging foil (not shown)—is then provided as a transport unit which can be transported to the building site for installation. Since each insulation boards 10 comprises an upper part 2 and a lower part 4 these upper parts 2 and the lower parts 4 appears alternately in the stack; however, each insulation board 10 comprising an upper part 2 and a lower part 4 is handled at the building site, e.g. on a roof, as single insulation boards 10 that can be arranged successively adjacent each other during the insulation installation process. After the insulation boards 10 are arranged, the upper parts 2, 2' are shifted for completing the building surface insulation installation. The upper parts 2, 2' may be shifted immediately after installation of each insulation board 10 or they may be shifted after installation of a plurality of insulation boards 10.

With reference to FIGS. 4A and 4B, the insulation board 10 may be produced initially as a dual density board by a conventional process and then subjected to a horizontal cutting member 16, such as a knife or a saw, and thereby split into an upper part 2 and the lower part 4. This split may be provided at the interface between the low density and the high density layers in the dual density product. However by the invention it is realised that the split may also be provided at another level relative to the density transition point.

After the splitting action is completed, the insulation board 10 may be individually wrapped in a wrapping foil 12 as shown in FIG. 4C and/or the insulation boards 10 may be stacked on a pallet 18 as shown in FIG. 4D.

The invention claimed is:

1. A method for heat insulating a building surface with a plurality of insulation boards, wherein each of the plurality of insulation boards has two parallel main surfaces and four side surfaces connecting the two parallel main surfaces, whereby:

the plurality of insulation boards are arranged adjacently one another on the building surface with each of the plurality of insulation boards having a lowermost of the two parallel main surfaces facing the building surface, wherein each of the plurality of insulation boards is divided into an upper part and a lower part with an interface that is substantially parallel with the two parallel main surfaces, and the method comprising:

arranging one of the plurality of insulation boards on the building surface and then shifting the upper part of said insulation board a distance parallel with respect to the two parallel main surfaces to at least partly cover a lower part of at least one neighboring insulation board of the plurality of insulation boards.

2. The method according to claim 1, wherein the building surface is a flat, or substantially flat, roof.

3. An insulation board for heat insulating a building surface, the insulation board comprising:

an upper part comprising a top main surface, a lower part comprising a bottom main surface that is parallel with respect to the top main surface, and four side surfaces connecting the top main surface and the bottom main surface, with an interface between the upper part and the lower part that is substantially parallel with respect to the top main surface and the bottom main surface, wherein the upper part of the insulation board is configured to shift relative to the lower part of the insulation board from a position substantially overlying the lower part of the insulation board to a position shifted relative to the lower part of the insulation board a distance parallel with respect to the top and bottom main surfaces, such that the upper part of the insulation board at least partly covers a lower part of at least one neighboring insulation board, and wherein the upper part of the insulation board and the lower part of the insulation board are each made of a fibrous mineral material.

4. The insulation board according to claim 3, wherein the upper part of the insulation board has a first density within a range of 100-200 kg/m$^3$ and the lower part of the insulation board has a second density within a range of 50-250 kg/m$^3$, and wherein the first density is higher than the second density.

5. The insulation board according to claim 3, wherein the upper part of the insulation board has a first thickness which is 10-50% of a thickness of the insulation board and the lower part of the insulation board has a second thickness of 50-95% of the thickness of the insulation board.

6. The insulation board according to claim 3, wherein the upper part of the insulation board and the lower part of the insulation board are made of stone wool.

7. The insulation board according to claim 3, wherein the upper part of the insulation board is configured to shift relative to the lower part of the insulation board in two directions.

8. A method for producing a plurality of insulation boards, the method comprising:

producing a web of mineral wool insulation, said web having an upper surface and a lower surface;

curing said web of mineral wool insulation;

dividing the web of mineral wool insulation into an upper part and a lower part and keeping the upper part and the lower part together with an interface substantially parallel with the upper and lower surfaces; and cutting the web of mineral wool insulation along a length and a width of the web of mineral wool insulation into the plurality of insulation boards each defined by a portion of the upper part and a portion of the lower part, with a portion of the interface therebetween, such that the portion of the upper part is configured to shift relative to the portion of the lower part a distance parallel with respect to the portion of the interface, such that the portion of the upper part can at least partly cover a portion of a lower part of at least one neighboring insulation board of the plurality of insulation boards.

9. The method according to claim 8, whereby:

the curing of said web of mineral wool insulation is subsequent to the dividing of the web of mineral wool insulation into the upper part and the lower part and the keeping of the upper part and the lower part together with the interface substantially parallel with the upper and lower surfaces;

the upper part or the lower part is compressed to a higher density than the other of the upper part and the lower part.

10. The method according to claim 9, wherein the upper part is split from the lower part and;

wherein the upper part has a higher density than the lower part.

11. The method according to claim 10, whereby the split is provided at the interface between the upper part and the lower part.

12. The method according to claim 8, wherein each of the plurality of insulation boards, is wrapped individually in a packaging foil.

* * * * *